US007290370B2

(12) United States Patent
McCullough

(10) Patent No.: US 7,290,370 B2
(45) Date of Patent: Nov. 6, 2007

(54) ASSIST MECHANISM FOR LIFTING AND CLOSING LARGE ENCLOSURES

(75) Inventor: Andrew C. McCullough, Raymore, MO (US)

(73) Assignee: Smith & Loveless, Inc., Lenexa, KS (US)

( * ) Notice: Subject to any disclaimer, the term of this patent is extended or adjusted under 35 U.S.C. 154(b) by 421 days.

(21) Appl. No.: 10/888,229

(22) Filed: Jul. 9, 2004

(65) Prior Publication Data

US 2006/0005468 A1 Jan. 12, 2006

(51) Int. Cl.
*E05F 1/10* (2006.01)

(52) U.S. Cl. ..... 49/386

(58) Field of Classification Search ..... 49/386, 49/345, 339, 324; 16/286–288
See application file for complete search history.

(56) References Cited

U.S. PATENT DOCUMENTS 4,296,575 A * 10/1981 Verable et al. ..... 52/66
4,566,552 A * 1/1986 Hoffman et al. ..... 180/69.21
4,991,675 A * 2/1991 Tosconi et al. ..... 180/69.21
5,950,252 A * 9/1999 Fettes ..... 4/498
6,789,357 B1 * 9/2004 McCullough ..... 49/386

* cited by examiner

*Primary Examiner*—Jerry Redman
(74) *Attorney, Agent, or Firm*—Wood, Phillips, Katz, Clark & Mortimer

(57) ABSTRACT

An assist mechanism for assisting in the pivotal movement of an enclosure member between closed, intermediate, and open positions. A first biasing member has a swing arm pivotally connected to a strut and extends between a base plate and enclosure member, and a second biasing member has a link pivotally connected to a limited tension spring and also extends between the base plate and enclosure member, whereby each impart a substantially biasing force substantially on only one side of the intermediate position, with the first biasing member biasing the enclosure member away from the closed position, and a second biasing member biasing the enclosure member away from the open position.

22 Claims, 4 Drawing Sheets

ASSIST MECHANISM FOR LIFTING AND CLOSING LARGE ENCLOSURES

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

This invention is generally directed to a device or mechanism for assisting in the lifting of large enclosures. More specifically, this invention is directed to a device or mechanism for assisting in the lifting of a tall hood member such as may be used to provide above-ground entry into the mechanical section of a pumping station.

BACKGROUND OF THE INVENTION AND TECHNICAL PROBLEMS POSED BY THE PRIOR ART

It has hereto been common practice to use gas shocks to assist in the opening or lifting of large or tall enclosures. This was typically accomplished using one of two methods. In the first method, the gas shocks were under-sized to allow the user to still be able to close the enclosure, while still providing a degree of assistance. In the second method, the travel of the enclosure is limited to forty five degrees. This permits the gas shocks to be sized correctly, but prevents the enclosure from being fully opened unless the gas shocks are uninstalled. Both of these options require the use of an end restraint to prevent the hood from over-extending the gas shock and thereby shortening its life.

The design of assist mechanisms that utilize gas shocks for enclosures that are tall presents unique problems. While the gas shocks will successfully lift the enclosure, in the full open position (approximately ninety degrees from horizontal), the center of gravity is located behind the hinge. As a consequence thereof, in order to close the enclosure, the operator is required to not only overcome the weight of the enclosure, but also the strength of the gas shocks. This in turn limits the strength of the shock that can be used, as a stronger shock would severely hamper an operator's ability to close the enclosure. Since the strength of the gas shock is limited, the amount of assistance that can be supplied in opening the enclosure is also limited.

The alternative is to limit the travel of the enclosure such that the gas shocks do not push the center of gravity of the enclosure past the hinge. In some applications, this only allows for the enclosure to be opened about forty five degrees instead of ninety degrees, and therefore limits or restricts the access which can be gained through the enclosure. Some applications have allowed the gas shocks to be removed as a part of operating the enclosure when it is necessary to open it beyond the travel of the gas shocks.

Additionally, it has heretofore been necessary to take great care to prevent the gas shocks from over-extending, such as the utilization of an end-stop. If the gas shocks are permitted to fully extend before the endstop is engaged, the weight of the enclosure will tend to over-extend the shocks and thereby greatly reduce their useful life.

The present invention is directed toward overcoming one or more of the problems set forth above.

SUMMARY OF THE INVENTION

In accordance with the present invention, an assist mechanism is provided that decreases the work required by an operator to fully open an enclosure or hood for entry into a mechanical section of a system, such as a wastewater or sewage pumping station, and also decreases the work required to close an open hood.

In one aspect of the present invention, an assist mechanism is provided for assisting in the pivotal movement about an axis of an enclosure member with respect to a hinge on a body member between a closed position, an intermediate position, and an open position. The assist mechanism includes a first biasing member biasing the enclosure member away from the closed position, and a second biasing member biasing the enclosure member away from the open position. The second biasing member imparts substantially no biasing force on the enclosure member when the enclosure member is substantially between the intermediate position and the closed position.

In one form of this aspect of the invention, the enclosure member has a center of gravity, and the center of gravity is substantially vertically aligned with the axis when the enclosure member is in the intermediate position.

In another form of this aspect of the invention, the second biasing member extends from a first length with the enclosure member at the intermediate position to a second length with the enclosure member at the open position, and a limiting member limits the second biasing member from extending beyond the second length. In one further advantageous form, the second biasing member includes a coiled tension spring, and the limiting member comprises a chain in the spring, secured at spaced links to ends of the tension spring, where the chain is extendable to a maximum length of the second length between the spaced links.

In another further advantageous form, a link is pivotally secured at opposite ends to the body member and the second biasing member. In a still further advantageous form, the link has a selectively adjustable maximum length and may comprise a turnbuckle. In yet another still further form, the link has a length $L_1$ and the second biasing member in a non-biasing condition has a length $L_2$, with the link secured to the body member at a first connection and the second biasing member secured to the enclosure member at a second connection, where the first and second connections are spaced apart a distance of $L_1+L_2$ when the enclosure member is substantially In the intermediate position.

In yet another form of this aspect of the invention, the enclosure member has an center of gravity at an angle of X degrees above horizontal from the hinge when the enclosure member is in the closed position, and the second biasing member imparts a substantial biasing force only when the enclosure member is at a position pivoted at least about X degrees from the closed position. In further forms, the second biasing member imparts a substantial biasing force when the enclosure member is in the open position, and the enclosure member is in a horizontal position in the closed position, pivoted about (90−X) degrees above horizontal in the intermediate position, and pivoted an angle of at least about 90 degrees from the closed position in the open position.

In still another form of this aspect of the present invention, the first biasing member includes a swing arm member and an expansible strut member. The swing arm member has a first end portion and a second end portion, with the first end portion of the swing arm being pivotally connected to the body member. The expansible strut member has a first end portion and a second end portion, with the first end portion of the strut member being pivotally connected to the second end portion of the swing arm member and the second end portion of the strut being pivotally connected to the enclosure member. The strut has a contracted condition when the enclosure member is in its closed position and an extended condition when the enclosure is in its intermediate and open positions. When the closure member is in its closed and intermediate positions, the second end of the swing arm member and the first end of the strut member are in contact with the base plate. When the closure member is in its open position, the second end of the swing arm member and the first end of the strut member are spaced from the base plate member so that the strut member is neither assisting nor detracting from the opening or closing of the enclosure member. In further forms, the previously described forms of the second biasing member may be used.

BRIEF DESCRIPTION OF THE DRAWINGS

These and other features of the invention will appear from the following written description, and from the drawings, in which.

DETAILED DESCRIPTION OF THE INVENTION

Figure 1:
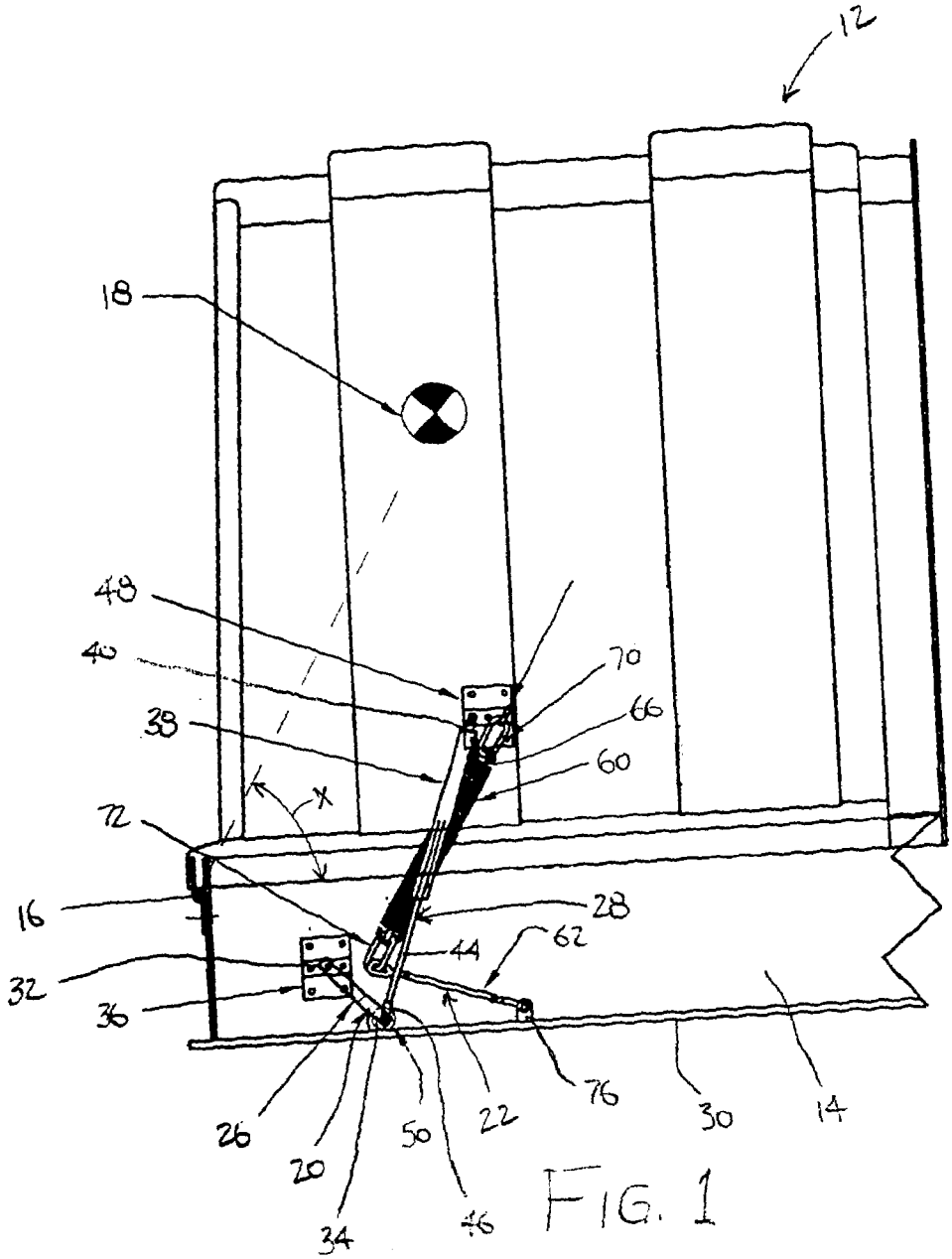
FIG. 1 is a schematic elevational view showing the lift mechanism in accordance with the invention, with the enclosure member in its closed position.
Figure 2:
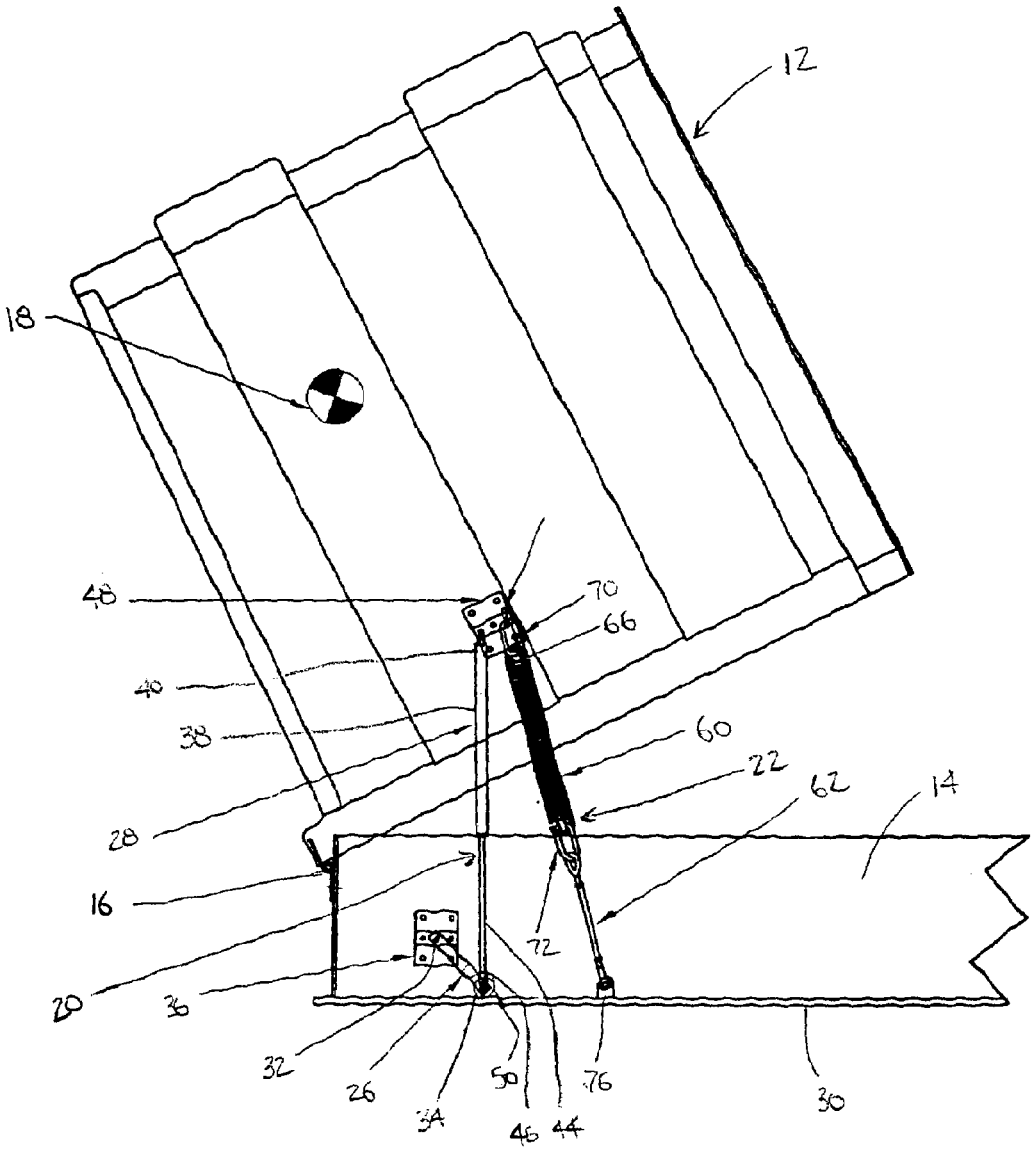
FIG. 2 is a similar view of FIG. 1, but showing the enclosure member in its intermediate position.
Figure 3:
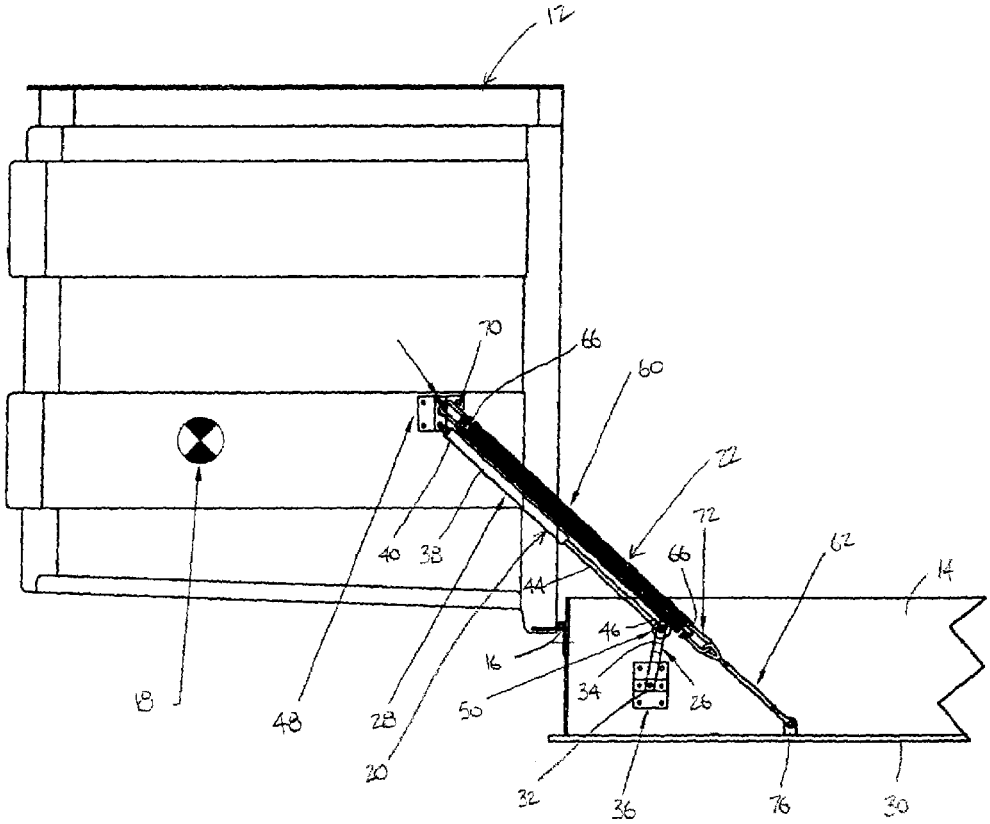
FIG. 3 is a similar view to FIG. 1, but showing the enclosure member in its fully open position.

Referring to FIGS. 1-3, an assist mechanism constructed in accordance with the present invention is indicated at 10. The assist mechanism 10 is shown in combination with an enclosure or hood member 12 associated with the body portion 14 such as may house a mechanical system, such as a wastewater or sewage pumping station. The enclosure member 12 is pivotally hinged, as at 16, to the body portion 14 in any suitable manner.

As illustrated, the enclosure member 12 may have a tall profile, with the present invention being particularly applicable for use in connection with heavy enclosure members that have a tall profile. With such a tall profile, it will be appreciated that the enclosure member 12 will have a center of gravity 18 which will be located above the bottom of the enclosure member 12 (i.e., at an angle of X degrees at the enclosure member hinge from the horizontal bottom of the enclosure member as illustrated in FIG. 1). In this configuration, lifting of the enclosure member 12 will require lifting of the weight of the enclosure member through a pivoting of about (90−X) degrees, at which point the center of gravity 18 will essentially be vertically aligned with the axis of the hinge 16. This is the intermediate position (FIG. 2) of the enclosure member 12, which frequently will not provide a large enough opening for a person to conveniently gain access to the interior of the body portion 14.

Further opening pivoting of the enclosure member 12 beyond the intermediate position will be "assisted" by the weight of the enclosure member 12, in the sense that the weight of the enclosure member 12 may alone be sufficient to cause further opening of the enclosure member 12. However, that weight could potentially accelerate the enclosure member 12 as it further opens, and cause damage if not sufficiently constrained or taken into account. Further, that weight in the over-center condition when fully open (FIG. 3) must be overcome in order to move the enclosure member 12 back to its closed position.

To overcome these problems, the assist mechanism 10 includes first and second biasing members 20, 22, with the first biasing member 20 assisting in lifting (opening) the enclosure member 12 and the second biasing member 22 assisting in closing the enclosure member 12. Both biasing members 20, 22 also assist in controlling potentially damaging falling movement of the enclosure member 12 in the direction opposite their biasing force such as described in detail below.

Specifically, the first biasing member 20 includes a swing arm member 26, and an expansible strut member or gas shock 28 which is biased toward expanding (i.e., extending its length). It is contemplated that the assist mechanism 10 may be provided on each side of the enclosure member 12 to facilitate opening and closing of the enclosure member 12. The body portion 14 is provided with a base plate 30 extending therefrom.

The swing arm member 26 is a link arm member having a first end portion 32 and a second end portion 34. The first end portion 32 is pivotally attached to the body portion 14, for example, by pivotally attaching to a first bracket member 36 suitably attached to the body portion 14. The bracket member 36 may be advantageously provided with a plurality of spaced apart openings through which a pivot pin passing through the first end portion 32 may extend.

The expansible strut member 28 may advantageously be a conventional gas strut or shock member having a cylinder portion 38 defining a first end portion 40 and a rod portion 44 defining a second end portion 46.

The first end portion 40 of strut member 28 is pivotally attached to a side portion of the enclosure member 12. For example, the first end portion 40 may be advantageously pivotally attached to a second bracket member 48 suitably attached to the enclosure member 12. The second bracket member 48 may be advantageously provided with a plurality of spaced apart openings through which a pivot pin passing through the first end portion 40 of the strut member 28 may extend.

The second end portion 46 of the strut member 28 is suitably pivotally attached to the second end portion 34 of the swing arm member 26.

For reasons that will hereinbelow become more apparent, the pivot point between the swing arm member 26 and the strut member 28 is urged into contact with the base plate 30 by the force of the gas strut and the weight of the enclosure when the enclosure is in its closed and intermediate positions. A suitable bumper member 50 is preferably provided at the pivot point between the swing arm member and the strut member. The bumper member 50 may advantageously be of plastic or other suitable material which prevents the linkage from marring the surface of the base plate 30 when biased thereagainst.

Referring to FIG. 1, the enclosure member 12 is shown in its closed position in covering relationship to the body portion 14. The strut member 28 is in its contracted condition and the bumper member 50 is in contact with and pushing on the base plate 30.

When it is desired to gain access to the body portion 14, the operator provides an upward lifting force to the enclosure member 12. In so doing, the strut member 28 assists in the lifting of the enclosure member into the intermediate or partially open position shown in FIG. 2. In the intermediate position, the strut member 28 is fully extended and substantially supports the weight of the enclosure member 12. The bumper member 50 is still pressed against the base plate 30 by the force of the strut member 28 and the weight of the enclosure member 12.

During continued lifting of the enclosure member 12 beyond the intermediate position (FIG. 2) to its fully open position (FIG. 3), the bumper member 50 is lifted off the base plate 30 since the strut member 28 cannot extend beyond its length at the intermediate position. At this point (i.e., with the enclosure member 12 open beyond the intermediate position), the strut member 28 is neither assisting nor detracting from the opening or closing of the enclosure member 12.

Therefore, it should be appreciated that the strut member 28 may be selected to provide a relatively large biasing force to assist in opening the enclosure member from the closed position to the intermediate position without also undesirably adding to the difficulty associated with the closing of the enclosure member 12 from the open position to the intermediate position (since the operator does not have to overcome the adverse moment generated by the strut member 28 while moving the enclosure member from its fully open position to its intermediate position). Moreover, in addition to assisting in opening the enclosure member from the closed position to the intermediate position, the strut member 28 will assist in safely closing the enclosure member from the intermediate position to the closed position by tending to counterbalance the weight of the enclosure member 12 as it closes, thereby preventing the enclosure member 12 from being accidentally dropped hard into its closed position. Moreover, it should be appreciated that the swing arm member 26 permits the bumper member 50 to move off the base plate 30, and also guides the bumper member to re-engage the base plate 30 at the appropriate position when the enclosure member 12 is moved back to the intermediate position from the open position.

Figure 4:
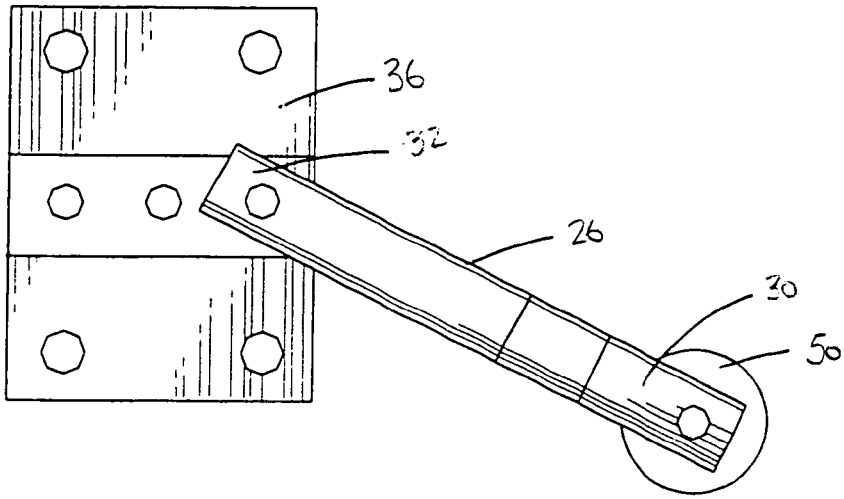
FIG. 4 is a schematic view showing the attachment of the swing arm member to the bracket member.

Referring to FIG. 4, to increase the effectiveness of the strut member 28, and hence its strength, the swing arm 26 may be moved to an opening in the bracket member 36 furthest from the hinge between the enclosure member 12 and the body portion 14. This extends the useful life of the strut member 28 and permits adjustment of the assist to the operator's taste.

The first biasing member 20 is also disclosed in U.S. patent application Ser. No. 10,434,591, filed May 9, 2003 and entitled "Lift Assist Mechanism for Lifting Large Enclosures", the complete disclosure of which is hereby incorporated by reference.

The second biasing member 22 in the disclosed embodiment consists of a extension or tension spring 60 of suitable strength as will be apparent hereinbelow, and a link member 62.

A suitable limiting member 66 is suitably secured to opposite ends of the spring 60 and permits extension of the spring 60 up a selected length. The limiting member 66 may advantageously be a heavy duty chain 66 extending through the coil of the spring 60 (and thereby between its end links being substantially hidden in the Figures), with the ends of the spring 60 secured (e.g., by welding) to spaced apart links of the chain 66, where the spaced apart links may be spaced no more than the length of the tension spring 60 in a non-extended (i.e., non-biasing) position when the chain 66 is in a relaxed condition, with the spaced apart links being spaced apart the selected length when the chain 66 is fully extended. It should be appreciated that the chain 66 will therefore provide a limit to the extension of the spring 60 while at the same time permitting free functioning of the spring up to that limit. Moreover, the chain 66 will function as a safety restraint by preventing spring material from being expelled in a ballistic manner as could otherwise occur during catastrophic failure of such springs.

Suitable quick links 70, 72 may be provided at both ends of the chain 66 to pivotally secure the spring 60/chain 66 at one end to the enclosure member 12 (e.g., to the second bracket member 48) and to pivotally secure the spring 60/chain 66 at the other end to the link member 62. For example, stainless steel quick links 70, 72 having C-shapes with a threaded closure may be advantageously used to connect the closed link at the end of the chain 66 to a closed eyelet on the link member 62, as well as to connect the closed link at the other end of the chain 66 to second bracket member 48.

The opposite end of the link member 62 is suitably pivotally connected to a suitable bracket 76 on the base plate 30.

It should thus be appreciated that, while the first biasing member 20 assists in lifting the weight of the enclosure member 12 when the enclosure member is between the closed and intermediate positions, the second biasing member 22 will exert essentially no force on the enclosure member 12.

Once the enclosure member 12 reaches the intermediate or neutral position (FIG. 2), the space between the points of connection of the second biasing member 22 to the enclosure member 12 and to the base plate 30 will be substantially equal to the combined length of the spring 60 and the link member 62. In fact, the link member 62 may advantageously be a turnbuckle permitting easy adjustment of the length of the link member 62 to provide such a condition during installation. (The turnbuckle may also be used to adjust for variances in the strength of the spring 60. For example, the turnbuckle may be shortened to ensure that a greater extension of the spring 60 occurs at the open position and thereby provide a greater biasing force at that position when desired.)

At this point, further opening of the enclosure member 12 beyond the intermediate position will both disengage the first biasing member 20 as previously described (i.e., the bumper member 50 will disengage from the base plate 30) while also engaging the second biasing member 22 by beginning to stretch the spring 60 beyond its non-biasing position. As such, the second biasing member 22 will exert a force on the enclosure member 12 which biases the enclosure member toward the intermediate position, such biasing force tending to counteract the weight of the enclosure member 12 which, in that over-center condition, tends to bias the enclosure member 12 toward the open position. Therefore, the second biasing member 22 will counteract the force of gravity causing the enclosure member 12 to fall open, and thereby minimize any damage from any hard fall of the enclosure member 12 which might otherwise occur due to gravity. Further, the second biasing member 22 will assist in returning the enclosure member 12 to the intermediate position from the open position by providing a balancing force which tends to counterbalance the weight of the enclosure member. Still further, when the enclosure member 12 passes the intermediate position toward the closed position, the first biasing member 20 will re-engage as previously described to counterbalance the falling weight of the enclosure member, and the second biasing member 22 will cease to provide its unneeded biasing force.

It should thus be appreciated that the assist mechanism 10 of the present invention may be advantageously used to provide the desired assistance through all ranges and directions of motion, such assist being reliably provided through a long desired useful life.

It should be appreciated, however, that while the general transition between biasing forces of the first and second biasing members 20, 22 will advantageously occur at the neutral position of the enclosure member 12 (i.e., the position in which the center of gravity 18 is exactly vertically aligned with the axis of the hinge 16), it would fall within the scope of the invention for one or both of the biasing members 20, 22 to begin biasing the enclosure member 12 slightly before the neutral position, and/or to cease biasing the enclosure member 12 slightly after the neutral position, with such operation provided to suit particular needs and tastes of the operator. For example, the first biasing member 20 could be configured so as to exert a biasing force on the enclosure member 12 slightly beyond the neutral (intermediate) position to ensure that the enclosure member 12 is biased toward being fully open and thereby minimize the chance that the enclosure member 12 accidentally fall back down to its closed position if released when in its intermediate position.

It should also be appreciated that the biasing members 20, 22 may be advantageously configured to provide a substantial biasing force, but that such force need not be sufficient to completely counter all other forces in any or all positions. Rather, the biasing forces should be substantial so as to provide an appreciable assist to an operator in moving the enclosure member 12 in various positions. As such, "substantial biasing force" is used herein to describe a force which is more that merely incidental, and does not include, for example, an incidental force such as might arise due to the weight of a component secured off-center to the enclosure member 12.

The foregoing disclosure is the best mode devised by the inventor for practicing this invention. It is apparent, however, that apparatus incorporating modifications and variations will be obvious to one skilled in the art. Still other aspects, objects, and advantages of the present invention can be obtained from a study of the specification, the drawings, and the appended claims. The specification and the drawings are intended to enable one skilled in the pertinent art to practice the instant invention, which should not be construed to be limited thereby but should be construed to include such aforementioned obvious variations and be limited only by the spirit and scope of the following claims. Moreover, it should be understood that the present invention could be used in alternate forms where less than all of the objects and advantages of the present invention and preferred embodiment as described above would be obtained.

The invention claimed is:

1. In combination, an assist mechanism for assisting pivotal movement about an axis of an enclosure member with respect to a hinge on a body member between a closed position, an intermediate position, and an open position, comprising:

a first biasing member biasing said enclosure member away from said closed position from said closed position substantially to said intermediate position, said first biasing member imparting substantially no biasing force on said enclosure member when said enclosure member is substantially between said intermediate position and said open position;

a second biasing member biasing said enclosure member away from said open position from said open position substantially to said intermediate position, said second biasing member imparting substantially no biasing force on said enclosure member when said enclosure member is substantially between said intermediate position and said closed position.

2. The assist mechanism of claim 1, wherein said enclosure member has a center of gravity, and said center of gravity is substantially vertically aligned with said axis when said enclosure member is in said intermediate position.

3. The assist mechanism of claim 1:

wherein said second biasing member extends from a first length with said enclosure member at said intermediate position to a second length with said enclosure member at said open position, and further comprising a limiting member limiting said second biasing member from extending beyond said second length.

4. The assist mechanism of claim 3, wherein said second biasing member includes a coiled tension spring, and said limiting member comprises a chain in said spring, secured at spaced links to ends of said tension spring, said chain being extendable to a maximum length of said second length between said spaced links.

5. The assist mechanism of claim 3, further comprising a link pivotally secured at opposite ends to said body member and said second biasing member.

6. The assist mechanism of claim 5, wherein said link has a selectively adjustable maximum length.

7. The assist mechanism of claim 6, wherein said link comprises a turnbuckle.

8. The assist mechanism of claim 5, wherein:

said link has a length $L_1$ and said second biasing member in a non-biasing condition has a length $L_2$;

said link is secured to said body member at a first connection;

said second biasing member is secured to said enclosure member at a second connection; and said first and second connections are spaced apart a distance of $L_1+L_2$ when said enclosure member is substantially in said intermediate position.

9. The assist mechanism of claim 1, wherein said enclosure member has an center of gravity at an angle of X degrees above horizontal from said hinge when said enclosure member is in said closed position, and said second biasing member imparts a substantial biasing force only when said enclosure member is at a position pivoted at least about X degrees from said closed position.

10. The assist mechanism of claim 9, wherein said second biasing member imparts a substantial biasing force when said enclosure member is in said open position.

11. The assist mechanism of claim 9, wherein said enclosure member is in a horizontal position in said closed position, pivoted an angle of about 90 minus X degrees above horizontal in said intermediate position, and pivoted an angle of about at least about 90 degrees from said closed position in said open position.

12. The assist mechanism of claim 1, wherein said first biasing member comprises:

a swing arm member having a first end portion and a second end portion, said first end portion of said swing arm being pivotally connected to said body member;

an expansible strut member having a first end portion and a second end portion, said first end portion of said strut member being pivotally connected to said second end portion of said swing arm member and said second end portion of said strut being pivotally connected to said enclosure member, said strut having a contracted condition when the enclosure member is in its closed position and an extended condition when said enclosure is in its intermediate and open positions;

whereby when said enclosure member is in its closed and intermediate positions said second end of said swing arm member and said first end of said strut member are in contact with said body member, and when said closure member is in its open position said second end of said swing arm member and said first end of said strut member are spaced from said body member so that said strut member is neither assisting nor detracting from the opening or closing of the enclosure member.

13. The assist mechanism of claim 12, wherein said enclosure member has a center of gravity, and said center of gravity is substantially vertically aligned with said axis when said enclosure member is in said intermediate position.

14. The assist mechanism of claim 12:

wherein said second biasing member extends from a first length with said enclosure member at said intermediate position to a second length with said enclosure member at said open position, and further comprising a limiting member limiting said second biasing member from extending beyond said second length.

15. The assist mechanism of claim 14, wherein said second biasing member includes a coiled tension spring, and said limiting member comprises a chain in said spring, secured at spaced links to ends of said tension spring, said chain being extendable to a maximum length of said second length between said spaced links.

16. The assist mechanism of claim 14, further comprising a link pivotally secured at opposite ends to said body member and said second biasing member.

17. The assist mechanism of claim 16, wherein said link has a selectively adjustable maximum length.

18. The assist mechanism of claim 17, wherein said link comprises a turnbuckle.

19. The assist mechanism of claim 16, wherein:

said link has a length $L_1$ and said second biasing member in a non-biasing condition has a length $L_2$;

said link is secured to said body member at a first connection;

said second biasing member is secured to said enclosure member at a second connection; and said first and second connections are spaced apart a distance of $L_1+L_2$ when said enclosure member is substantially In said intermediate position.

20. The assist mechanism of claim 12, wherein said enclosure member has an center of gravity at an angle of X degrees above horizontal from said hinge when said enclosure member is in said closed position, and said second biasing member imparts a substantial biasing force only when said enclosure member is at a position pivoted at least X degrees from said closed position.

21. The assist mechanism of claim 20, wherein said second biasing member imparts a substantial biasing force when said enclosure member is in said open position.

22. The assist mechanism of claim 20, wherein said enclosure member is in a horizontal position in said closed position, pivoted an angle of about 90 minus X degrees above horizontal in said intermediate position, and pivoted an angle of at least about 90 degrees from said closed position in said open position.

* * * * *